United States Patent [19]

Williams et al.

[11] 4,121,498

[45] Oct. 24, 1978

[54] PIVOTAL POSITIONING SERVOACTUATOR

[75] Inventors: Leonard J. Williams, East Aurora; Leon W. Blank, Grand Island, both of N.Y.

[73] Assignee: Moog Inc., East Aurora, N.Y.

[21] Appl. No.: 765,253

[22] Filed: Feb. 3, 1977

[51] Int. Cl.[2] ..... F15B 9/03; F15B 9/09; F01B 1/00

[52] U.S. Cl. ..... 91/186; 91/363 R; 92/146; 92/249

[58] Field of Search ..... 91/186, 363 R, 363 A, 91/411; 92/167, 146, 61, 248, 249, 108, 126

[56] References Cited

U.S. PATENT DOCUMENTS

| | | | |
|---|---|---|---|
| 373,072 | 11/1887 | Jarvis | 92/167 |
| 1,747,968 | 2/1930 | Braren | 92/167 |
| 2,235,475 | 3/1941 | Bruegger | 92/126 |
| 2,461,877 | 2/1949 | Brereton | 91/186 |
| 3,521,535 | 7/1970 | Oelrich | 91/186 |
| 3,716,310 | 2/1973 | Guenther | 92/249 |
| 3,750,532 | 8/1973 | Kubilos | 91/186 |
| 3,763,745 | 10/1973 | Anderson | 91/186 |
| 3,968,736 | 7/1976 | Pecorori | 92/167 |

FOREIGN PATENT DOCUMENTS

| | | | |
|---|---|---|---|
| 301,062 | 11/1962 | Netherlands | 92/249 |
| 1,382,191 | 1/1975 | United Kingdom | 92/249 |

*Primary Examiner*—Paul E. Maslousky
*Attorney, Agent, or Firm*—Sommer & Sommer

[57] ABSTRACT

A two-axis positioning servoactuator includes a support, a movable member arranged adjacent the support for independent pivotal movement relative thereto about each of two perpendicular intersecting axes, a pair of differential piston and cylinder actuators operatively interposed between the support and movable member for effecting such angular movement about each of the axes, an electrohydraulic servovalve for each of the actuators and operatively associated therewith to control the same, and means providing a position feedback signal to the corresponding servovalve for effecting controlled movement of the member about each of the axes.

8 Claims, 7 Drawing Figures

PIVOTAL POSITIONING SERVOACTUATOR

BACKGROUND OF THE INVENTION

1. Field of the Invention

The present invention relates generally to positioning apparatus for displacing a movable member to a desired position relative to a support, and more particularly to improved servoactuator apparatus for accurately positioning such movable member relative to a support angularly about either or both of two axes in response to an electrical command signal.

2. Description of the Prior Art

Conventional hydraulic actuators for positioning a swivelled load, such as an antenna, a mirror, a gun, a rocket engine, a telescope, or the like, have included a piston and cylinder operatively arranged to impart translational motion to an end of a radius arm located remote from the effective pivot point. Two of such actuators have been used, each arranged ninety degrees from the other, to create a two-axis positioning system. Such known forms of two-axis hydraulic actuators have been used to control aximuth and elevation, pitch and yaw, or the like.

Alternatively, rotary hydraulic actuators have been used in such positioning systems. However, these rotary actuators generally include internally-moving parts, such as pistons, gears, vanes, and the like.

A two-axis positioner should, desirably, be highly accurate and have high dynamic response characteristics. Upon information and belief, these desired degrees of accuracy and dynamic response have been heretofore limited by several factors, such as backlash in mechanical couplings, friction in such couplings, compliance of such couplings, and fluid compliance due to its compressibility under load. Inasmuch as these factors serve to limit system accuracy and dynamic response, it is generally desired to minimize or eliminate such factors to maximize total system performance.

SUMMARY OF THE INVENTION

The present invention broadly provides an improved positioning servoactuator, which may be used to displace a movable member angularly about an axis to a desired commanded position. The inventive servoactuator provides freedom for movement in such direction but minimizes the aforementioned unwanted factors. As such, it has advantageous application for certain high accuracy, two-axis positioning systems. One limitation of the invention is that only a rather small positioning arc is available. However, in many applications, such as providing a fine adjustment for directing a laser beam, this limitation is not unreasonable.

The inventive improvement is particularly adapted for use in a two-axis positioning servoactuator having a support and having a movable member arranged adjacent the support for independent angular movement relative thereto about each of two perpendicular intersecting axes.

The improvement broadly comprises at least one positioning means operatively arranged to move the member angularly about an axes. Each of the positioning means includes: means forming a first cylinder in one of the support and member; means forming a first piston in the other of the support and member, the first piston being mounted in the first cylinder for relative movement therealong and sealing an expansible first chamber therebetween which may be supplied with pressurized fluid to move the member in one angular direction about the associated axis; an electrohydraulic servovalve operatively arranged to selectively supply pressurized fluid in response to a command signal; and first conduit means communicating the first chamber with the servovalve; whereby, when the servovalve is operated to supply pressurized fluid to the first chamber, one of the first piston and cylinder may move arcuately relative to the other of the first piston and cylinder to move the member in the one angular direction about the associated axis.

The inventive positioning means may further include means forming a second cylinder in one of the support and member; means forming a second piston on the other of the support and member, the second piston being mounted in the second cylinder for relative movement therealong and sealing an expansible second chamber therebetween which may be supplied with pressurized fluid to move the member in the opposite angular direction about the associated axis; and second conduit means communicating the second chamber with the servovalve; whereby, when the servovalve is operated to supply pressurized fluid to the second chamber; one of the second piston and cylinder may move arcuately relative to the other of the second piston and cylinder to move the member in the opposite angular direction about the associated axis.

The improved positioning means may further include at least one position sensing means operatively arranged to sense the angular position of the member relative to the support about the associated axis; and at least one summing means operatively arranged to compare such sensed position with the command signal and to supply the difference therebetween as an error signal to the servovalve.

Moreover, the improvement may further include a flexure pivot joining the member and support at a point on the axis to provide a fulcrum for pivotal movement of the member relative to the support, and/or an elastomeric seal operatively arranged between the first piston and cylinder to seal the first chamber to accommodate non-linear movement of the pistons relative to their cylinders.

Preferably, each servovalve is of the open-center jet-type operatively arranged to discharge a jet of pressurized fluid toward receptor passages communicating with the first and second piston end chambers, such that the position of the jet relative to these receptor passages may determine the relative pressures in the first and second chambers.

Accordingly, one general object of the present invention is to provide improved positioning means for use in a two-axis positioning servoactuator in which a member may be moved relative to a support about either or both of two intersecting perpendicular axes.

Another general object is to provide an improved positioning servoactuator in which a movable member may be accurately displaced to a commanded position relative to a support.

Another general object is to provide an improved positioning servoactuator having minimum fluid volume between the servovalve and a piston and cylinder means, thus affording high dynamic response characteristics to an input command signal.

Still another object is to provide an improved twoaxis positioning servoactuator having a member mounted for pivotal movement relative to a support without intermediate links, bearings or other mechanical devices that could contribute backlash.

These and other objects and advantages will become apparent from the foregoing and ongoing specification, the drawings, and the appended claims.

DESCRIPTION OF THE PREFERRED EMBODIMENTS

Figure 1:
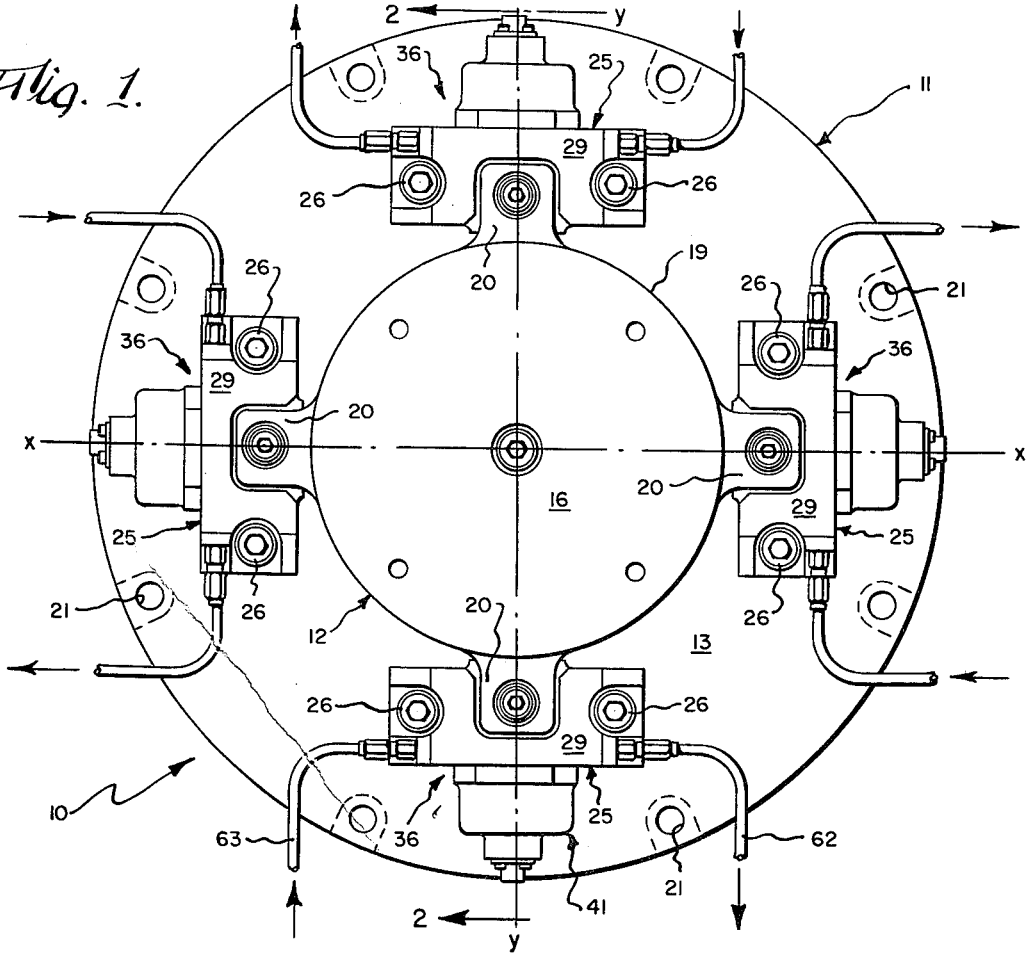
FIG. 1 is a fragmentary front elevation of an improved two-axis positioning servoactuator incorporating the inventive positioning means, this view particularly showing the movable member pivotally mounted on the support as having four ears, and four electrohydraulic servovalves operatively associated with such movable member ears.

At the outset, it should be clearly understood that like reference numerals are intended to identify the same elements and/or structure consistently throughout the several drawing figures, as such elements and/or structure may be further described or explained by the entire written specification of which this detailed description is an integral part.

Referring collectively to the several drawing figures, the present invention provides an improvement for a pivotal positioning servoactuator, of which a presently preferred embodiment is generally indicated at 10.

Figure 2:
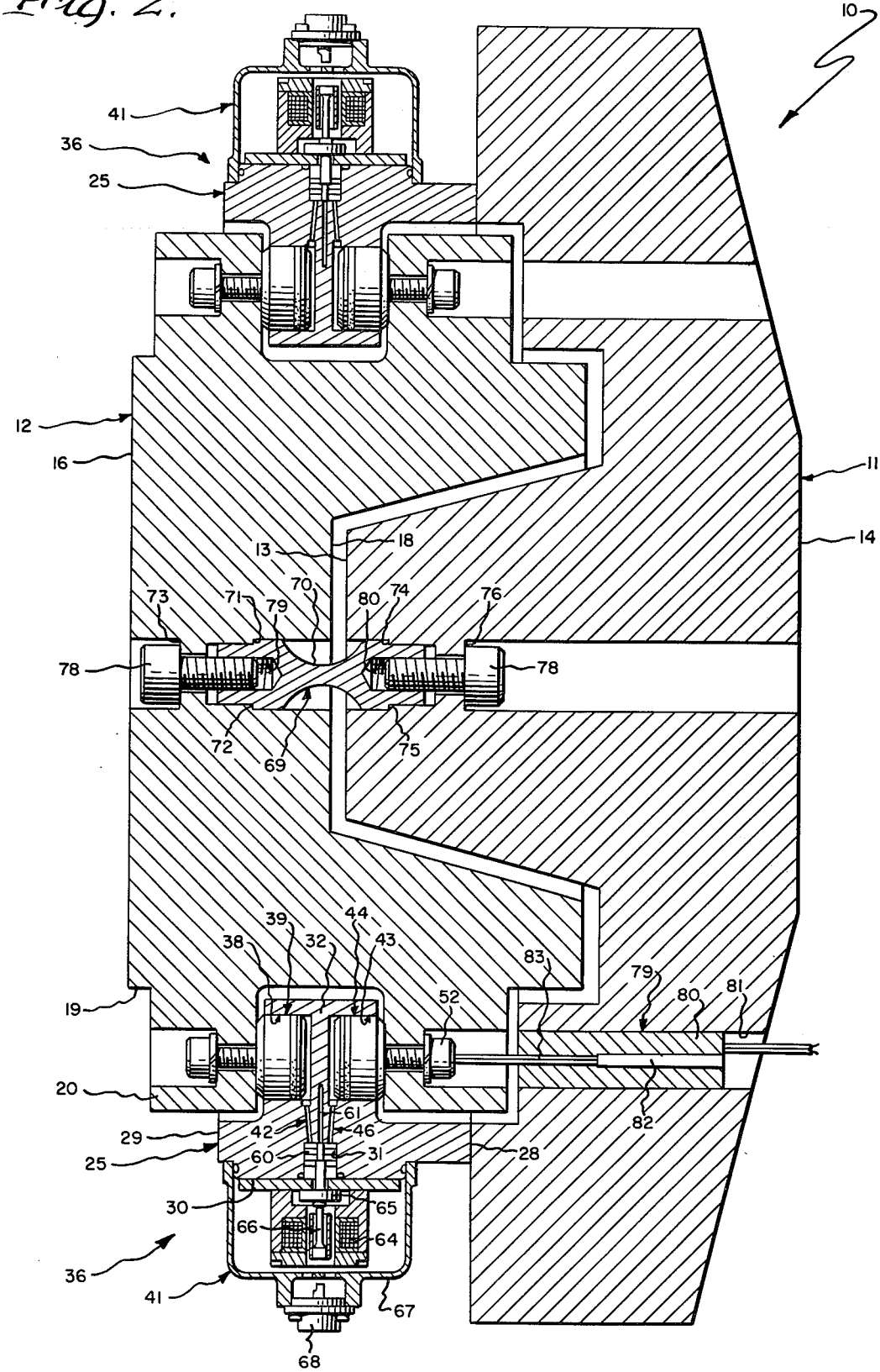
FIG. 2 is an enlarged fragmentary transverse vertical sectional view thereof, taken generally on line 2-2 of FIG. 1, this view particularly showing the support, the movable member, the inventive positioning means with its associated electrohydraulic servovalve and position feedback means, and the omnidirectional flexure pivot.

As best shown in FIGS. 1 and 2, this servoactuator is of the two-axis type, and broadly includes a support, generally indicated at 11, which is adapted to be suitably secured to a suitable object (not shown), and a load member, generally indicated at 12, arranged adjacent the support for independent angular movement relative thereto about either or both of two perpendicular axes, these being conventionally denominated in FIG. 1 as the horizontal x-x axis and the vertical y-y axis.

While the support 11 and member 12 may be formed in many different shapes and configurations, the illustrated support 11 is best shown in FIG. 2 as having a left face 13, a right face 14, and a cylindrical outer surface 15. Similarly, the movable member 12 is shown as having a left face 16, a right face 18 configured complementarily to the support left face 13 such that the various facing surfaces of these faces 13, 18 are normally spaced substantially equidistant from one another, and a cylindrical outer surface 19 from which four ears, severally indicated at 20, extend radially outwardly along each axis for a purpose hereinafter explained. This support is shown as being further provided with a plurality of circularly-spaced mounting holes 21 (FIG. 1) to accommodate passage of a corresponding plurality of suitable fasteners (not shown) by which the support may be mounted on an object (not shown).

Figure 3:
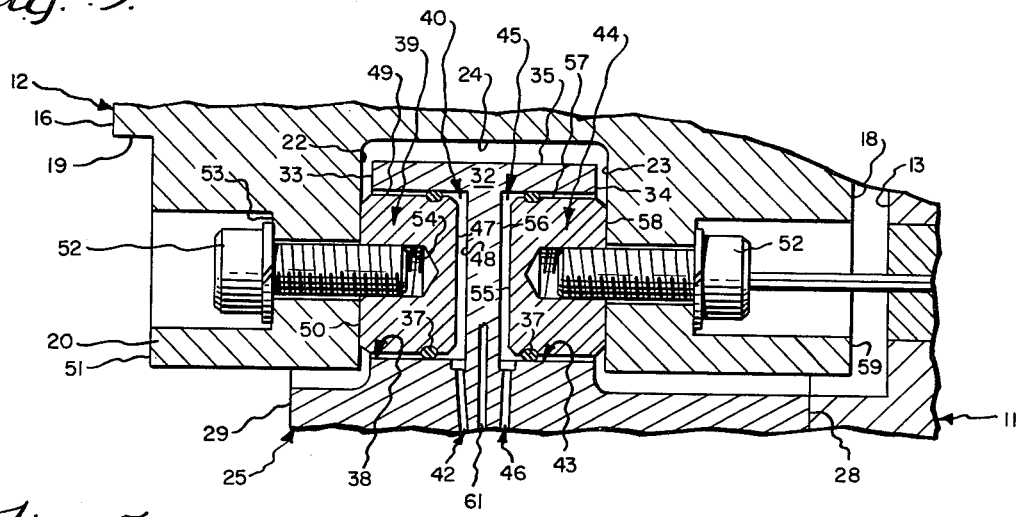
FIG. 3 is a further enlarged fragmentary vertical sectional view of one of the positioning means, this view being taken longitudinally through the lower differential piston and cylinder actuator shown in FIG. 2, and illustrates the centered positions of the first and second pistons relative to the stationary member.

Referring now to FIGS. 2 and 3, each of the movable member ears 20 is shown provided with a generally tangential groove or recess extending in a direction transverse to the radial direction in which the ear extends. As best shown in FIG. 3, the groove through the bottom ear is bounded by a rightwardly-facing substantially-rectangular vertical left surface 22, an opposite leftwardly-facing substantially-rectangular vertical right surface 23, and an intermediate horizontal inner surface 24.

In the illustrated embodiment, the support is shown as including four body blocks, severally indicated at 25 (FIGS. 1 and 2), each of which extends outwardly (leftwardly in FIG. 2) from support left face 13 to proximately embrace one of the movable member ears 20. When viewed in front elevation (FIG. 1), each of these body blocks 25 appears to have a generally elongated rectangular outline, and is shown as having a substantially U-shaped recess arranged to receive one of the ears 20. These body blocks 25 are adapted to be rigidly secured to the support by means of a pair of bolt-like fasteners 26 (FIG. 1).

Referring now to FIG. 2, these body blocks 25 are shown as having, in transverse cross-section taken along the *y—y* axis, a vertical right face 28 arranged to abut support left face 13, an opposite vertical left face 29, an outer surface 30 from which a recess 31 extends radially inwardly, and an innermost portion 32 operatively arranged in the slot or groove provided in the movable member ear 20. As best shown in FIG. 3, each of these body block innermost portions 32 is bounded by a substantially-rectangular vertical left surface 33 arranged to face movable member groove left surface 22, an opposite substantially-rectangular vertical right surface 34 arranged to face movable member groove right surface 23, and a substantially-rectangular horizontal intermediate surface 35 arranged to face movable member groove intermediate surface 24. Of course, these various facing surfaces 22 and 33, 23 and 34, 24 and 35, are spaced from one another to enable the member 12 to move pivotally about an associated axis, as comparatively illustrated in FIGS. 3–5.

The inventive improvement provides at least one positioning means, generally indicated at 36 (FIG. 2), which is operatively arranged to move the load member 12 angularly about an axis, such as one of the *x—x* and *y—y* axes. Each of the positioning means 36 includes means forming a first cylinder 38 (FIG. 3) in one of the support and member; means forming a first piston 39 in the other of the support and member, this first piston being operatively mounted in the first cylinder 38 for relative movement therealong and carrying an elastomeric O-ring 37 to seal an expansible first chamber 40 therebetween which may be supplied with pressurized fluid to move the member 12 in one direction, this being clockwise in FIGS. 3-5; an electrohydraulic servovalve, generally indicated at 41 (FIG. 2), operatively arranged to selectively supply pressurized fluid in response to a command signal; and first conduit means 42 communicating the hydraulic output of the servovalve with the first chamber; whereby, when the servovalve is operated to supply pressurized fluid to the first chamber, one of the piston and cylinder may move arcuately relative to the other of the first piston and cylinder to move the member in the one angular direction about the associated axis.

Figure 4:
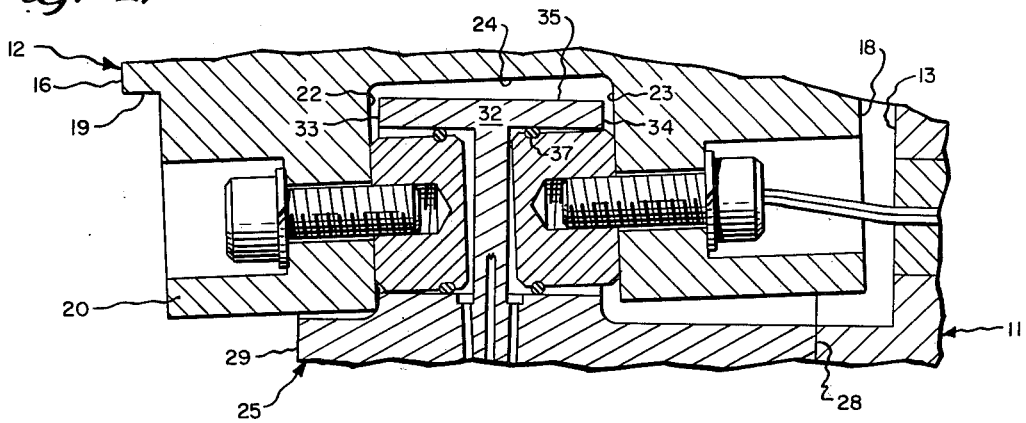
FIG. 4 is a view generally similar to FIG. 3, but showing the exaggerated positions of the first and second pistons relative to the stationary member when the associated servovalve has displaced that portion of the movable member toward the support.
Figure 5:
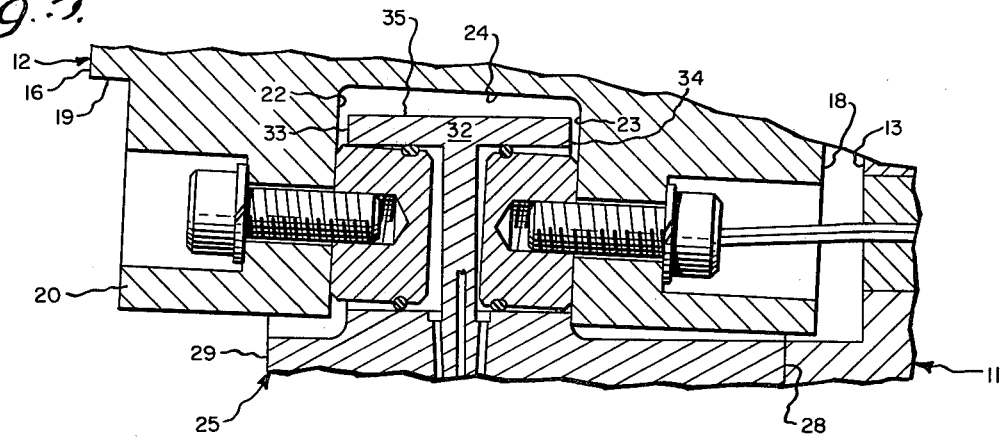
FIG. 5 is a view generally similar to FIG. 3 but showing the exaggerated positions of the first and second pistons relative to the stationary member when the associated servovalve has displaced that portion of the movable member away from the support.

Still referring princiaplly to FIGS. 2 and 3, the inventive positioning means 36 may, if desired, further include means forming a second cylinder 43 in one of the support and member; means forming a second piston 44 on the other of the support and member, this second piston being operatively mounted in the second cylinder for relative movement therealong and carrying an elastomeric O-Ring 37 to seal an expansible second chamber 45 therebetween which may be supplied with pressurized fluid to move the member 12 in the opposite angular direction about the associated axis; and second conduit means 46 communicating the second chamber with the hydraulic section of the servovalve; whereby, when the servovalve is operated to supply pressurized fluid to the second chamber, one of the second piston and cylinder may move arcuately relative to the other of the second piston and cylinder to move the member in the opposite angular direction, this being counter clockwise in FIGS. 3-5, about the associated axis.

Referring now principally to FIG. 3, the body block innermost section 32 is shown as being provided with a left and right cylindrical recesses which extend horizontally into this member toward one another from the left and right surfaces 33, 34, respectively. The left recess constitutes the means forming the first cylinder 38, and the right recess constitutes the means forming the second recess 43.

The first and second pistons 39, 44 are shown as being mounted on the movable member, and are operatively arranged within the first and second cylinders 38, 43, respectively. To this end, the first piston 38 is shown as having a circular vertical right face 47 arranged to move toward and away from the leftwardly-facing circular vertical toward and away from the leftwardly-facing circular vertical bottom surface 48 of the first cylinder 38, a cylindrical outer surface 49, and a circular vertical left face 50 arranged to abut movable member surface 22. A stepped hole is shown as communicating the movable member ear left surface 51 with groove surface 22 to accommodate passage of a suitable bolt fastener 52. The head portion of this bolt fastener 52 is arranged to abut leftwardly-facing shoulder 53, and its threaded shank portion is arranged to be matingly received in tapped hole 54 extending rightwardly into first piston 39 from its left face 50. Hence, bolt fastener 52 may be selectively tightened to securely mount the first piston 39 on the movable member.

Similarily, the second piston 44 is shown as having a circular vertical left face 55 arranged to move toward and away from the rightwardly-facing circular vertical bottom surface 56 of the second cylinder 43, a cylindrical outer surface 57, and a circular vertical right face 58 arranged to abut movable member groove surface 23. Again, a stepped hole is shown as communicating the movable member ear right surface 59 with groove surface 23 to accommodate passage of another bolt fastener 52 which may be suitably tightened to securely mount the second piston on the movable member. In effect, the means forming the second piston 44 is a mirror image of the structure constituting the means forming the first piston 39. While the preferred embodiment illustrates the first and second pistons as being mounted on the movable member, and the first and second cylinders as being formed in the body blocks, which are part of the support, the present invention expressly contemplates that the relative positions of these operative piston and cylinder combinations may be reversed so that one or both pistons would be mounted on the support with their cooperative cylinders formed in the movable member.

While the electrohydraulic servovalve 36 may be of any suitable type, it is presently preferred to use a single-stage open-center servovalve, such as a deflector jet-type. This deflector jet servovalve is arranged to discharge a jet of pressurized fluid toward the juxtaposed entrances of a pair of receptor passages, whereby the deflectable direction of such jet relative to these entrances may determine the differential pressure or flow in turn communicated to the first and second chambers 40, 45 through first and second conduit-like passages 42, 46 respectively. These passages 42, 46 constitute the first and second conduit means communicating the hydraulic output section of the servovalve with the first and second chambers 40, 45, respectively.

Inasmuch as the structure and operation of this particular type of electrohydraulic servovalve is explicitly shown and described in U.S. Pat. Nos. 3,542,051 and 3,612,103, the aggregate disclosures of which are hereby incorporated by reference, the structure and operation of this servovalve need not be explicitly described herein. Suffice it to say here that such valve has a subassembly of wafer-like elements having the openings therethrough to provide an ejector nozzle, receptor passages and a return chamber, as shown in these patents, and that such subassembly is represented by the stack of elements, collectively indicated at 60 in FIG. 2, which stack is arranged in body block recess 31. The receptor passages, previously referred to, communicate with passages 42, 46. The return chamber referred to is serviced by a passage 61 which extends through the body block and leads to one side thereof to communicate with a return conduit 62 (FIG. 1) leading to a sump (not shown). Of course, the servovalve is supplied with such pressurized fluid from a source thereof (not shown) through supply conduit 63. Such a deflector jet-type of servovalve also includes a torque motor assembly 64, a deflectable flow guide 65, and a deflector member or flapper 66 carrying this flow guide.

Each servovalve 41 is further shown as including an enclosing cover 67 penetrated by a suitable electrical connector 68 through which an electrical command input signal may be supplied to the torque motor 64 for conversion to a proportional differential pressure or flow applied ultimately to the first and second piston end chambers 40, 45.

Therefore, in partial summary, each of the inventive positioning means 36 minimally includes means forming a first cylinder 38 in one of the support and member, means forming a first piston 39 on the other of the support and member, an electrohydraulic servovalve 41 operatively arranged to selectively supply pressurized fluid to an expansible first piston end chamber 40 is response to a command signal, and first conduit means 42 communicating the first chamber 40 with the servovalve, so that when the servovalve is operated to supply pressurized fluid to the first chamber, one of the first piston and cylinder may move along an arcuate path relative to the axis of the other of the piston and cylinder, this being shown in FIG. 5.

If desired, the positioning means 36 may further include means forming a second cylinder 43 in one of the support and member, means forming a second piston 44 on the other of the support and member, and second conduit means 46 communicating the servovalve with the second piston end chamber 45, so that when the servovalve is operated to supply pressurized fluid to the second chamber 45, one of the second piston and cylinder may move along an arcuate path relative to the other of the second piston and cylinder, this being shown in FIG. 4.

As previously noted, the illustrated embodiment is a two-axis positioning servoactuator having a pair of positioning means arranged to control movement of the member about each associated axis, and such positioning means are arranged on either side of the associated axis.

In the preferred embodiment, the movable member and support are joined at the intersection of the $x$—$x$ and $y$—$y$ axes by a flexure member 69 (FIG. 2) having an intermediate neck portion 70 of narrowed cross-section to permit omnidirectional pivotal movement of the member 12 relative to the support 11 through permissive flexure of neck portion 70. Hence, the member may pivot about either or both of the $x$—$x$ and $y$—$y$ axes, either sequentially or simultaneously, as desired. To accommodate this flexure member 69, a pair of aligned stepped holes are provided through the member and support. As best shown in FIG. 2, the hole through the movable member is provided with a rightwardly-facing annular vertical shoulder 71 arranged to abut a complementarily configured shoulder 72 on the flexure member, and is further provided with a leftwardly-facing annular vertical shoulder 73. Similarly, the hole provided through the support is provided with a leftwardly-facing annular vertical shoulder 74 arranged to abut a complementarily configured shoulder 75 provided on the flexure member, and is further provided with a rightwardly-facing annular vertical shoulder 76. A bolt fastener 78 may be inserted into each of these holes such that its head portion will abut shoulders 73, 76 with its threaded shank portion matingly received in tapped holes 79, 80 provided the left and right marginal end portions, respectively, of the flexure member. Hence, these bolt fasteners 78, 78 may be suitably tightened to secure the flexure member 69 to the movable member 12 and the support 11. When used, this flexure member effectively provides a fulcrum for pivotal movement of the load member 12 relative to the support 11.

If desired, the inventive positioning means may further include position sensing means, generally indicated at 79 in FIG. 2, operatively arranged to sense the actual angular position of the movable member relative to the support about the associated axis. In the preferred embodiment, such position sensing means 79 is shown as including a linear variable differential transformer (LVDT) having a stationary coil portion 80 operatively arranged in a hole 81 provided through the support, and having a movable slug portion 82 slidably mounted in the stationary coil portion and suitably connected to a proximate movable member bolt fastener 52 through an intermediate rod 83. Thus, movement of the movable member 12 reltive to the support 11 about the associated axis will produce a corresponding movement of slug portion 82 relative to stationary coil portion 80. This transformer acts substantially as a displacement transducer with its electrical output signal being a linear function of the position of slug portion 82 relative to coil portion 80.

Figure 6:
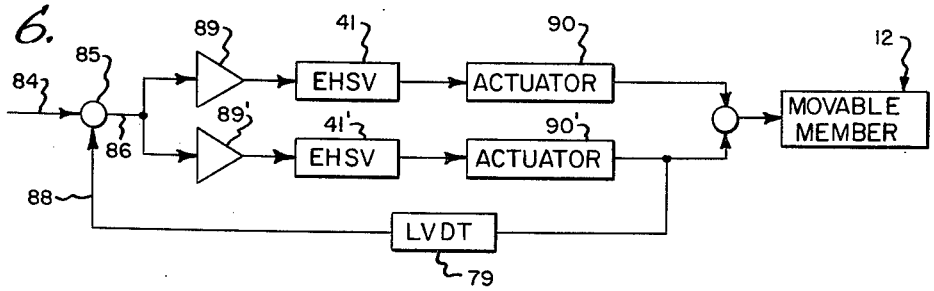
FIG. 6 is a schematic block diagram of the one form of the improved positioning means for moving the member about one axis, this schematic showing the improved positioning servoactuator as including a single position feedback device operatively associated with a cooperative pair of the positioning means.
Figure 7:
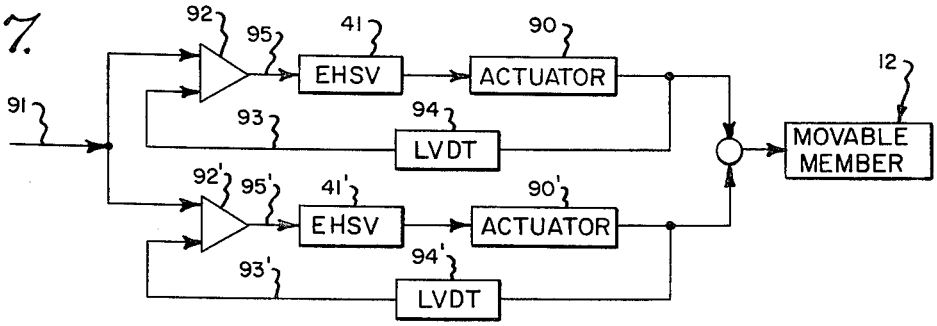
FIG. 7 is a schematic block diagram of another form of the improved positioning means, this schematic showing a separate position feedback device operatively associated with a cooperative pair of positioning means.

The position sensing means 79 may be used to provide a feedback signal reflecting the actual position of the movable member relative to the support about the associated axis, for example, in either of the schematics shown in FIGS. 6 and 7.

FIG. 6 illustrates a schematic of circuitry for controlling the complementary action of a pair of cooperative positioning means 36 on either side of an axis about which the movable member is to be pivoted when the flexure member 69 is used. Such circuitry could be used, for example, to control cooperative operation of the upper and lower servovalves in FIG. 1 if it were desired to pivot the movable member about the horizontal $x$—$x$ axis, as described herebelow.

In FIG. 6, a command input signal 84 is supplied to a summing point 85 which produces an error signal 86 as the difference between the command input signal and a feedback signal 88 supplied by the LVDT 79. This feedback signal reflects the actual position of the member about the associated axis. The error signal 86 is supplied to the torque motors of each cooperative pair of upper and lower servovalves 41, 41' through separate servoamplifiers 89, 89', respectively, which provide the necessary servoloop gain and dynamic compensation for each servovalve. The signals supplied to servovalves 41, 41' produce hydraulic outputs therefrom which are supplied to the appropriate expansible chamber of the first and second differential piston and cylinders of each positioning means, these being more conveniently indicated as upper and lower actuators 90, 90' in FIG. 6, to pivotally move member 12 about the associated axis. As previously noted, the LVDT is operatively arranged to sense the actual position of member 12 and to supply such sensed position as a feedback signal to the summing point 85. Hence, as the member 12 begins to move toward the position commanded by input signal 84, the LVDT 79 senses such movement as a change in actual position of the member 12 and supplies a correspondingly modified feedback signal 88 to the summing point 85. When the actual position of the member 12 corresponds to the commanded position, a zero error signal will be produced by the summing point. It must be remembered that if the member 12 is to be moved in a clockwise direction about the $x$—$x$ axis (FIG. 2), for example, the hydraulic output of the upper servovalve, indicated at 41 in FIG. 6, must be supplied to the right or second expansible chamber 44 of the upper actuator 90, and the hydraulic output of the lower servovalve indicated at 41', must be supplied to the left or first expansible chamber 40 of the lower actuator 90'. In this sense, the pairs of servovalves on either side of the axis must be operated cooperatively to produce the desired movement of member 12. In the schematic of FIG. 6, the flexure member 69 enables use of only one LVDT to sense actual position of the member 12.

An alternative schematic is illustrated in FIG. 7 for use with a servoactuator not having the flexure member 69. Without this flexure member 69, it will be appreciated that movement of the member on one side of the associated axis will not necessarily produce corresponding cooperative movement of the member on the other side of such axis. Hence, in this alternative embodiment, it is necessary to provide an LVDT feedback loop on either side of the axis.

In FIG. 7, a command input signal 91 is supplied to one terminal of each of a pair of upper and lower servoamplifiers 92, 92'. These servoamplifiers 92, 92' compare such commanded position with feedback signals 93, 93' supplied by upper and lower LVDT's 94, 94', to produce error signals 95, 95' supplied to the upper and lower servovalves 41, 41', respectively. These servovalves 41, 41' provide hydraulic drives to their respective differential piston and cylinder actuators 90,90' to produce desired movement of the member 12. The upper and lower LVDT's 94, 94' sense actual positive of the member on either side of the axis and produce feedback signals which are used to adjust the error signals supplied to the respective servovalves. In effect, by omitting the flexure member 69 and by operating the upper and lower positioning means independently, the movable member may be caused to pivot about a horizontal axis positioned anywhere between these positioning means.

While in the preferred embodiments herein illustrated and described, a pair of two diametrically-opposite positioning means have been used to move the member about each axis, this arrangement need not be invariably provided. Alternatively, only one such positioning means may be used to displace the movable member, as constrained by the flexure member, about each axis.

Another modification contemplated by the present invention is to use a single piston and cylinder combination to displace the movable member in one direction against an oppositely-directed bias exerted by a return spring (not shown) interposed between the movable load and the support. In this modification, the hydraulic drive provided to the piston and cylinder combination by the servovalve would be sufficient to overcome the opposite bias of the return spring to move the load in one direction. However, if such hydraulic drive were thereafter relaxed, the bias of the return spring would be sufficient to move the load in the opposite direction. Hence, in this embodiment, only one positioning means is needed to effect pivotal movement of the load in either of two directions about an axis.

Persons skilled in this art will also realize that other types of electrohydraulic servovalves may be used, albeit the disclosed type of servovalve affords the desirable capability of providing high dynamic response of the movable member of the desired command input signal because of the direct hydraulic coupling between the servovalve and the piston and cylinder actuator, without the need for intermediate manifolds, hydraulic lines and fittings, which would introduce unnecessary fluid compliance and thereby reduce dynamic response.

In summary, it should be appreciated that the unique positioning means herein disclosed accomplishes direct mechanical drive of the movable load without the need for intermediate bearings, piston rods, links, gimbal rings, or other mechanical mechanisms which would introduce undesirable backlash and compliance, which would detract from the positioning accuracy and dynamic response of the system.

Whereas an optional omnidirectional flexure pivot is shown in the drawings, it will be appreciated by those skilled in this art that an alternative type of mechanical pivot could also be employed.

Similarly, an LVDT has been illustrated and described as providing a position feedback signal. Alternatively, this feedback signal could be provided by another type of position transducer, such as a potentiometer or a variable reluctance device. In certain specific applications, it may be desirable to obtain such position feedback information from an object, such as a radar reflector or some other target, mounted on the movable member.

As noted in the foregoing specification, the support may be mounted on any suitable object, and any other suitable object may be mounted on the movable member. Thus, the present invention contemplates that the support may be mounted on either an immovable object, such as a tower or other static structure, or on a movable object, such as a vehicle. Of course, any of a large number of other objects, such as a mirror, a laser, a gun, a rocket engine, an antenna, a telescope, or the like, may be mounted on the movable member, this list being illustrative only and not limitative of the scope of the appended claims.

A unique feature of the present invention is the use of at least one cooperative position and cylinder combination wherein, when fluid is supplied to the piston end chamber, the piston may move non-linearly along an arcuate path relative to the axis of the cylinder. However, since the stroke of such piston travel is relatively small, the non-alignment of the piston with respect to the cylinder is accommodated through additional deformation of the O-Ring sealing the piston end chamber.

Therefore, while several preferred embodiments and modifications have been shown and described, persons skilled in this art will realize that various changes and additional modifications may be made without departing from the spirit of the invention, which is generically defined by the following claims.

What is claimed is:

1. In positioning apparatus having a support member and a movable member arranged adjacent said support member, the improvement which comprises:

means providing a pivotal axis about which said movable member is pivotal relative to said support member; and at least one positioning means operatively arranged to cause said movable member to pivot about said pivotal axis, each of said positioning means including a first cylinder means fixed to one of said members and arranged with its longitudinal axis offset with respect to said pivotal axis, a first piston means fixed to the other of said members, said first piston means being sealingly arranged in said first cylinder means for movement relative thereto along a first circular path about said pivotal axis, said first piston means defining with said first cylinder means a first operating chamber, and valve means selectively operable to control the flow of fluid with respect to said first chamber;

whereby movement of said first piston means relative to said first cylinder means along said first path effects pivotal movement of said movable member relative to said support member about said pivotal axis.

2. The improvement as set forth in claim 1 wherein each of said positioning means further includes:

a second cylinder means fixed to one of said members and arranged with its longitudinal axis offset with respect to said pivotal axis, a second piston means fixed to the other of said members, said second piston means being sealingly arranged in said second cylinder means for movement relative thereto along a second circular path about said pivotal axis, said second piston means defining with said second cylinder means a second operating chamber;

and wherein said valve means is selectively operable to control the flow of fluid with respect to said second chamber as well as with respect to said first chamber to effect a push-pull operation;

whereby movement of said second piston means relative to said second cylinder means along said second path also effects movement of said movable member relative to said support about said pitoval axis.

3. The improvement as set forth in claim 1 wherein said valve means is an electrohydraulic servovalve arranged to control the flow of fluid in response to a command signal, and wherein said positioning means further comprises:

position sensing means operatively arranged to sense the angular position of said movable member relative to said support member and said pivotal axis and provide a position feedback signal; and means operatively arranged to algebraically sum said feedback signal with said command signal and to provide the difference therebetween as an error signal for said servovalve.

4. The improvement as set forth in claim 1 wherein two of said positioning means are provided, each on opposite sides of said pivotal axis.

5. The improvement as set forth in claim 3 wherein two of said positioning means are provided, each on opposite sides of said pivotal axis.

6. The improvement as set forth in claim 1 wherein said means providing a pivotal axis includes a flexure pivot joining said movable and support members.

7. The improvement as set forth in claim 6 wherein said flexure pivot enables omnidirectional pivotal movement of said movable member relative to said support member.

8. The improvement as set forth in claim 1 and further comprising:

an elastomeric seal operatively arranged between said first piston means and first cylinder means.

* * * * *